US007901523B2

(12) United States Patent
Silvia et al.

(10) Patent No.: US 7,901,523 B2
(45) Date of Patent: Mar. 8, 2011

(54) UNIFORM HEAT TREATMENT PROCESS FOR HARDENING STEEL

(75) Inventors: Alan Joseph Silvia, Clifton Park, NY (US); Jeffrey Michael Breznak, Waterford, NY (US)

(73) Assignee: General Electric Company, Schenectady, NY (US)

( * ) Notice: Subject to any disclaimer, the term of this patent is extended or adjusted under 35 U.S.C. 154(b) by 772 days.

(21) Appl. No.: 11/941,149

(22) Filed: Nov. 16, 2007

(65) Prior Publication Data

US 2009/0126838 A1 May 21, 2009

(51) Int. Cl.
*C21D 1/06* (2006.01)

(52) U.S. Cl. ..... 148/559; 148/714; 432/10; 432/226

(58) Field of Classification Search ..... 148/567, 148/574, 575, 582, 591, 606, 625, 626, 640, 148/642, 714, 559; 219/618, 632, 634; 266/260, 266/261; 432/10, 226
See application file for complete search history.

(56) References Cited

U.S. PATENT DOCUMENTS 3,564,689 A 2/1971 Hirtenlechner
4,029,526 A 6/1977 Carrigan
4,818,833 A 4/1989 Formanack et al.
5,269,857 A * 12/1993 Ganesh et al. ..... 148/675
6,322,323 B1 11/2001 Komiyama et al.
6,432,229 B1 8/2002 Asai et al.
6,478,896 B1 11/2002 Ganesh et al.

OTHER PUBLICATIONS

"Selective Surface Hardening" by S. Lampman, in vol. 4 of ASM Handbook, (1991), ASM International, 5 pages total.*
M.K. Lee et al, Effects of the surface temperature and cooling rate on the residual stress in a flame hardening of 12Cr steel, Journal of Materials Processing Technology, vol. 176 (published Apr. 27th, 2006), p. 140-145.*
Flame Hardening of Steels, Mechanical Engineer, http://www.pageranknet.com/mechanical-engineer.mechanical-engineer-archives/15-flam . . . , 25 pages, Published May 12, 2007.

* cited by examiner

*Primary Examiner* — George Wyszomierski
*Assistant Examiner* — Mark L Shevin
(74) *Attorney, Agent, or Firm* — Cantor Colburn LLP

(57) ABSTRACT

Heat treatment processes for hardening a workpiece such as a turbine blade include attaching a spacer to a workpiece surface, wherein the spacer comprises an inner profile mirroring the workpiece surface and an outer profile effective to generally uniformly distribute heat to the workpiece surface, heating the spacer to uniformly heat the workpiece surface at a temperature effective to form an austenitic microstructure in the workpiece surface, cooling the workpiece surface at a rate effective to transform the austenitic microstructure to a martensitic microstructure, and removing the spacer from the workpiece prior to or subsequent to cooling.

18 Claims, 4 Drawing Sheets

UNIFORM HEAT TREATMENT PROCESS FOR HARDENING STEEL

BACKGROUND OF THE INVENTION

The present disclosure generally relates to heat treatment processes for forming martensitic steels, and more particularly, to a uniform flame hardening process for heat treatment of complex-shaped alloys such as may be employed in power generation systems.

Flame hardening and induction hardening are heat treatment processes in which a thin surface shell of a metal part is heated rapidly to a temperature above the metal's critical point. As the austenite cools, it often transforms into a mixture of ferrite and cementite as the dissolved carbon falls out of solution. If the rate of cooling is very fast, the alloy may experience a slight lattice distortion known as martensitic transformation, instead of transforming into a mixture. The rate of cooling determines the relative proportions of these materials and therefore the mechanical properties (e.g. hardness, tensile strength) of the steel. Using steel as an example, after the grain structure has become austenitic (austenitized), the part is quickly quenched, transforming the steel from the austenite phase to a martensite phase For example, slow cooling can cause transformation to pearlite, bainite, and martensite, with the final structure being a combination of the three. Of these different phases, the martensite phase provides desirable properties such as hardness, wear resistance, and the like. In contrast, other phases such as pearlite and bainite can result in relatively soft and ductile steel. To achieve hardness, therefore, the steel must be cooled rapidly so that it bypasses the first transformation phases and transforms directly from austenite to martensite. Hardening results in high wear resistance.

Flame hardening typically employs direct impingement of a high-temperature flame or high-velocity combustion product gases onto the part. The part is then cooled at a rate that will produce the desired levels of hardness and other properties. The high temperature flame is obtained by combustion of a mixture of fuel gas with oxygen or air; flame heads are used for burning the mixture. Depths of hardening typically range from about 0.8 to 25.4 mm or more depending on the fuels used, the design of the flame head, the duration of heating, the hardenability of the work material, the quenching medium and method of quenching used, and the shape of the part.

Induction hardening generally includes heating a metal part by electromagnetic induction, where eddy currents are generated within the metal and resistance leads to Joule heating of the metal. An induction heater generally includes an electromagnet, through which a high-frequency Alternating current (AC) is passed. Heat may also be generated by magnetic hysteresis losses. The depth of induction hardened patterns can be controlled through choice of induction-frequency, power-density and interaction time.

The use of the above noted heat treatment processes permits a part to be machined when in the softened state greatly reducing time and equipment wear as well as allowing the part to be made from a less costly material, thereby effecting an overall cost saving in comparison with other technically acceptable methods. For example, the process gives inexpensive steels the wear properties of alloyed steels, and parts can be hardened without scaling or decarburization, thereby eliminating costly cleaning operations.

Turbine blades can be fabricated from hardened steels as well as other alloys and are often used in harsh environments. The blades, particularly on their leading edge and their tip, typically require a material hardness capable of withstanding the extreme conditions to prevent erosion wear during operation. Uniform hardness and optimized grain sizes across the various surfaces is desirable to maximize performance. However, uniform hardening of complex shapes such as turbine blades is oftentimes difficult to achieve. Significant variations in microstructure across the surface can occur as a result of current hardening processes. The flame hardening process typically exposes the entire structure to heat, which can become excessive in low thickness areas and insufficient in areas of greater thicknesses. As an example, prior art FIG. 1 is a photographic image of a blade tip illustrating the problem associated with existing hardening processes. The magnified images show a close-up of both the blade tip (FIG. 2) and the base airfoil structure (FIG. 3) for comparison. As can be seen there is a significant difference between the grain size of the blade tip and the grain size of the base airfoil. The blade tip has been overheated, leading to a larger than desired grain size, which can lead to erosion and performance problems for the turbine blade.

Accordingly, a need exists for a heat treatment process that can provide a uniform microstructure for complex-shaped components.

BRIEF DESCRIPTION OF THE INVENTION

Disclosed herein are heat treatment processes for hardening a workpiece. In one embodiment, the process comprises attaching a spacer to a workpiece surface, wherein the spacer comprises an inner profile mirroring the surface of the workpiece and an outer profile effective to distribute heat generally uniformly across the workpiece surface; heating the spacer to uniformly heat the workpiece surface, wherein the heating is at a temperature effective to forms an austenitic microstructure in the workpiece surface; cooling the workpiece surface at a rate effective to transform the austenitic microstructure to a martensitic microstructure; and removing the spacer from the hardened workpiece prior to or subsequent to cooling.

In another exemplary embodiment, a heat treatment process for hardening a metal workpiece includes matingly engaging a spacer to a shaped workpiece, wherein the spacer has an inner profile that mirrors the shape of the workpiece and an outer profile effective to permit a generally uniform heating flux to form across a surface of the shaped workpiece, heating the spacer and the shaped workpiece to cause a first generally uniform heat flux on the surface of the shaped workpiece, cooling the spacer and the shaped workpiece to cause a second generally uniform heat flux on the surface of the shaped workpiece, wherein the cooling is at a rate effective to increase a hardness property to the surface of the workpiece, and removing the spacer from the shaped workpiece.

The above described and other features are exemplified by the following figure and detailed description.

BRIEF DESCRIPTION OF THE DRAWINGS

Referring now to the figures wherein the like elements are numbered alike.

DETAILED DESCRIPTION OF THE INVENTION

Figure 2:
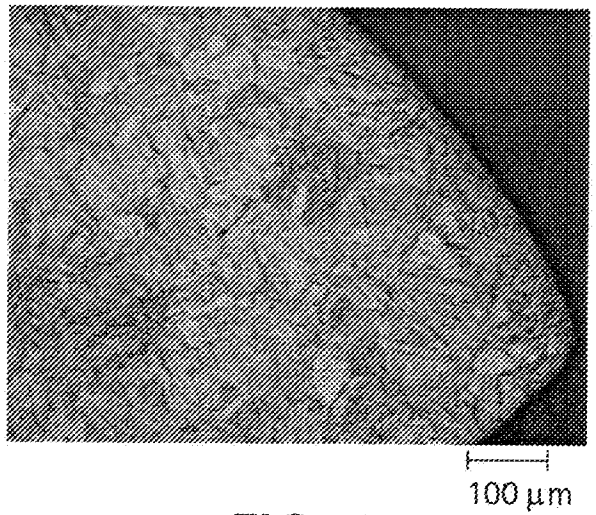
FIG. 2 shows a magnified image of the blade tip of the turbine blade in FIG. 1.
Figure 3:
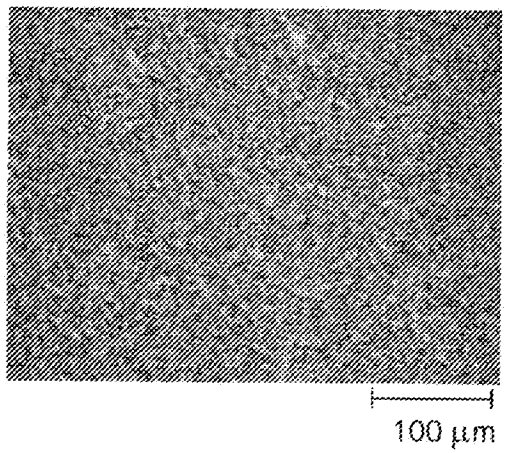
FIG. 3 shows a magnified image of the base airfoil structure of the turbine blade of FIG. 1.
Figure 1:
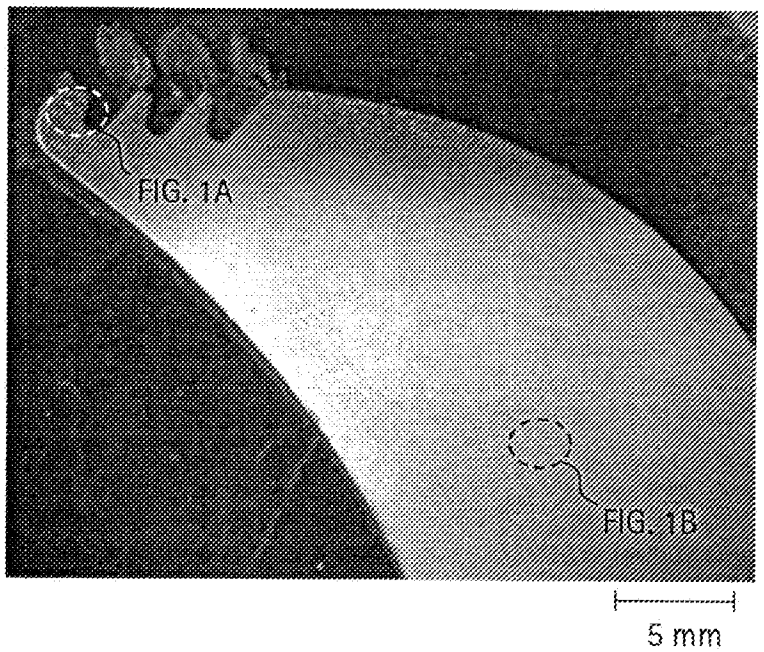
FIG. 1 is a photographic image of a turbine blade hardened by a prior art process.

Disclosed herein are heat treatment processes that provide uniform heating to the part regardless of shape or thickness. In one embodiment, the hardening heat treatment process includes temporarily disposing and/or attaching a spacer material over a shaped workpiece in order to distribute heat evenly across the workpiece shape. The spacer can be provided with a complementary shape to the part to be hardened and can be configured to have dimensions so as to provide uniform heating during the heat treatment processes. As an example, the use of the spacer can be used to harden complex shaped parts such as a turbine blade tip.

Uniform properties of hardened materials are important to the performance of turbine blades, particularly the moveable blades (e.g., buckets) of turbines. For example, later stages of a steam turbine can be driven by wet steam, which has lost thermal energy and contains large quantity of water droplets. The wet steam can cause erosion to the turbine blade's leading edge, i.e., the front side edge with respect to turbine steam flow, as well as to the blade tip. Since the moveable turbine blades in the final stage of the turbine are longer compared with those in the remaining stages, they undergo greater centrifugal force and vibration stresses. As erosion occurs, the stability of the blades becomes a real concern. Incorporating blades with uniform microstructures into the steam turbines can improve the erosion and stress corrosion performance of the turbines.

The hardening heat treatment process as disclosed herein permits a metal workpiece to be uniformly heated and cooled regardless of the shape complexity, thereby generating a uniform microstructure of the hardened blade material. The disclosed process can be particularly suitable for blade edges and blade tips having complex shapes, such as, for example, slinger grooves. Current heat treatment processes, for example, flame hardening of steel, impinge a flame directly over the blade and the blade tip. Therefore, the heating source (e.g., the flame) contacts both the thick and the thin portions of the blade tip profile without prejudice. For blades having complex geometries, with grooves, ridges, and the like, uniform heating and cooling is difficult. For instance, thin portions of the blade tip can be heated beyond the desired temperature, while the thicker portions are not heated enough. The non-uniformity causes different phase transformations in the metal to occur, leading to variations in metal grain size and reducing the material hardness. This can lead to erosion of the turbine blade during use. The non-uniformly heated blade is subject to, among other things, propagation of cracks in the overheated portions of the blade tip. While the description of the process disclosed herein is made with reference to its application for hardening turbine blades, it is to be known that this process can be applicable to the hardening of any workpiece wherein a hardened uniform microstructure is desirable for the performance and lifespan of the workpiece. Exemplary workpieces for hardening can include, without limitation, crankshafts, piston rods, sprockets, transmission gears, and the like.

The hardening heat treatment process as disclosed herein overcomes the non-uniformity problems in the prior art by temporarily modifying the shape of the blade. A spacer, e.g., a metal strip, can be temporarily disposed and/or attached to a workpiece to be hardened, e.g., the turbine blade. The spacer permits complex shapes to be uniformly heated and cooled using an automated heating tool, because the spacer has an outer surface which can be heated evenly, which will then conduct the heat uniformly to the workpiece. This provides a faster, more repeatable process than manually heating differing regions of a turbine blade for different durations at different temperatures. The hardening heat treatment process as disclosed herein also permits the use of a wider variety of blade geometries than is currently available due to current heat treatment shortcomings. In one embodiment, the hardening heat treatment process comprises matingly engaging a spacer onto a blade, wherein the spacer comprises an inner profile mirroring the outer surface of the blade and an outer profile effective to distribute heat uniformly across the blade, heating the blade by applying a heat source to the outer profile of the spacer, wherein the heating is sufficient to attain a blade temperature which forms an austenitic structure, and cooling the blade by applying a cooling source to the outer profile of the spacer, wherein cooling is at a rate sufficient to transform the austenitic structure to a martensitic structure, whereby the inner and outer profile of the spacer is effective to generate a hardened blade comprising a uniform microstructure, and removing the spacer from the hardened blade.

In another embodiment, the hardening heat treatment process includes matingly engaging a spacer to a shaped workpiece, wherein the spacer has an inner profile that mirrors the shape of the workpiece and an outer profile effective to permit a uniform heating flux across the shaped workpiece, heating together the spacer and the shaped workpiece to cause a first uniform heat flux on a surface of the shaped workpiece, cooling together the spacer and the shaped workpiece to cause a second uniform heat flux on the surface of the shaped workpiece, whereby the heating and the cooling of the spacer is effective to generate a hardened shaped workpiece comprising a uniform microstructure, and removing the spacer from the hardened shaped workpiece.

Figure 4:
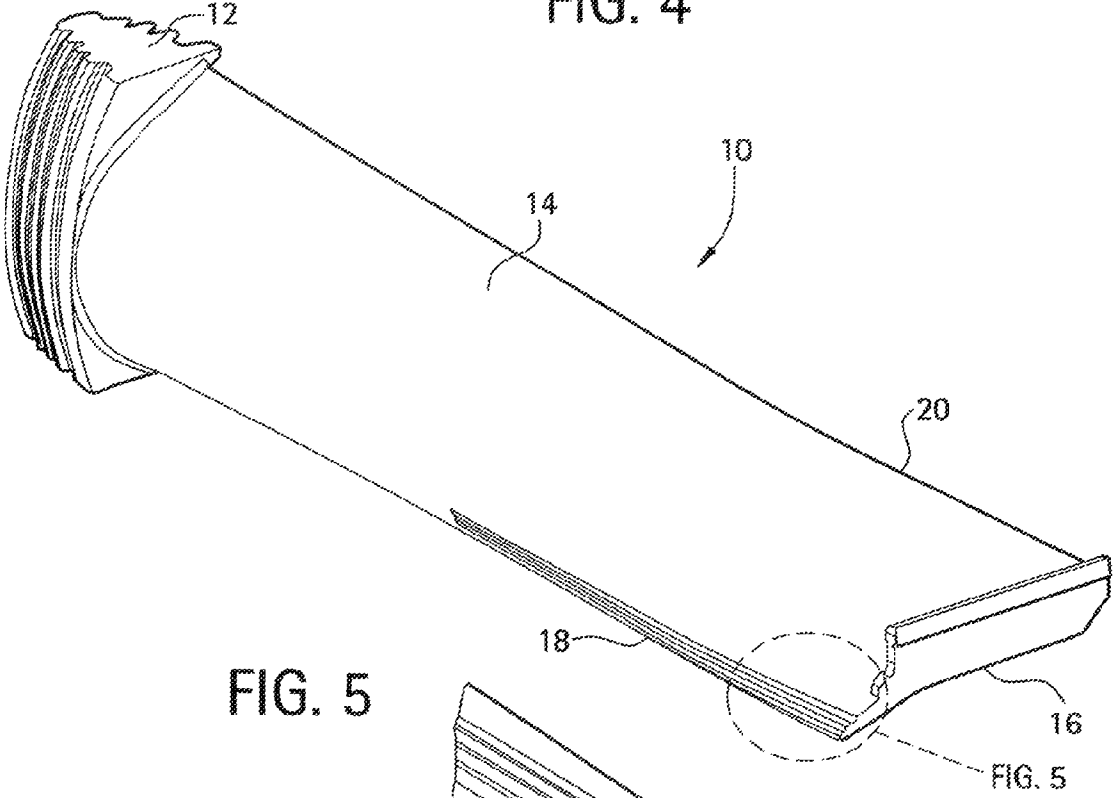
FIG. 4 is an exemplary embodiment of a turbine blade.
Figure 5:
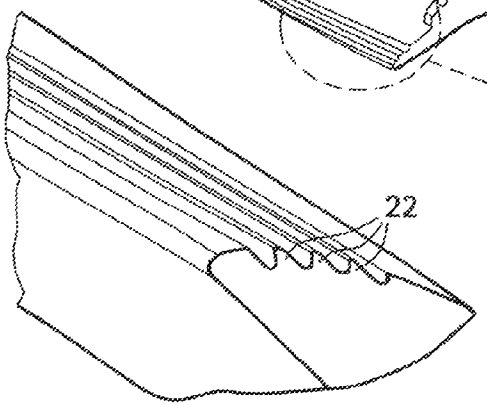
FIG. 5 shows a magnified view of the leading edge and tip of the turbine blade of FIG. 4.

Turning now to FIG. 4, a turbine blade 10 suitable for hardening by the disclosed process is illustrated. The turbine blade 10 has a root portion 12, an airfoil portion 14, and a blade tip portion 16 at the radially outer end of the blade 10. The blade also has a leading edge 18 and a trailing edge 20. FIG. 5 is a magnified view of the leading edge 18 and blade tip 16. The magnified view better illustrates the surface profile of the leading edge 18. In this embodiment, the leading edge of the turbine blade 10 has a plurality of grooves 22 (i.e., contours) to affect the aerodynamics and performance of the turbine blade. It is this example of intricate leading edge and blade tip profiles, which makes uniformly hardening the desired portion of the turbine blade 10 such a difficult process.

Figures 6, 7:
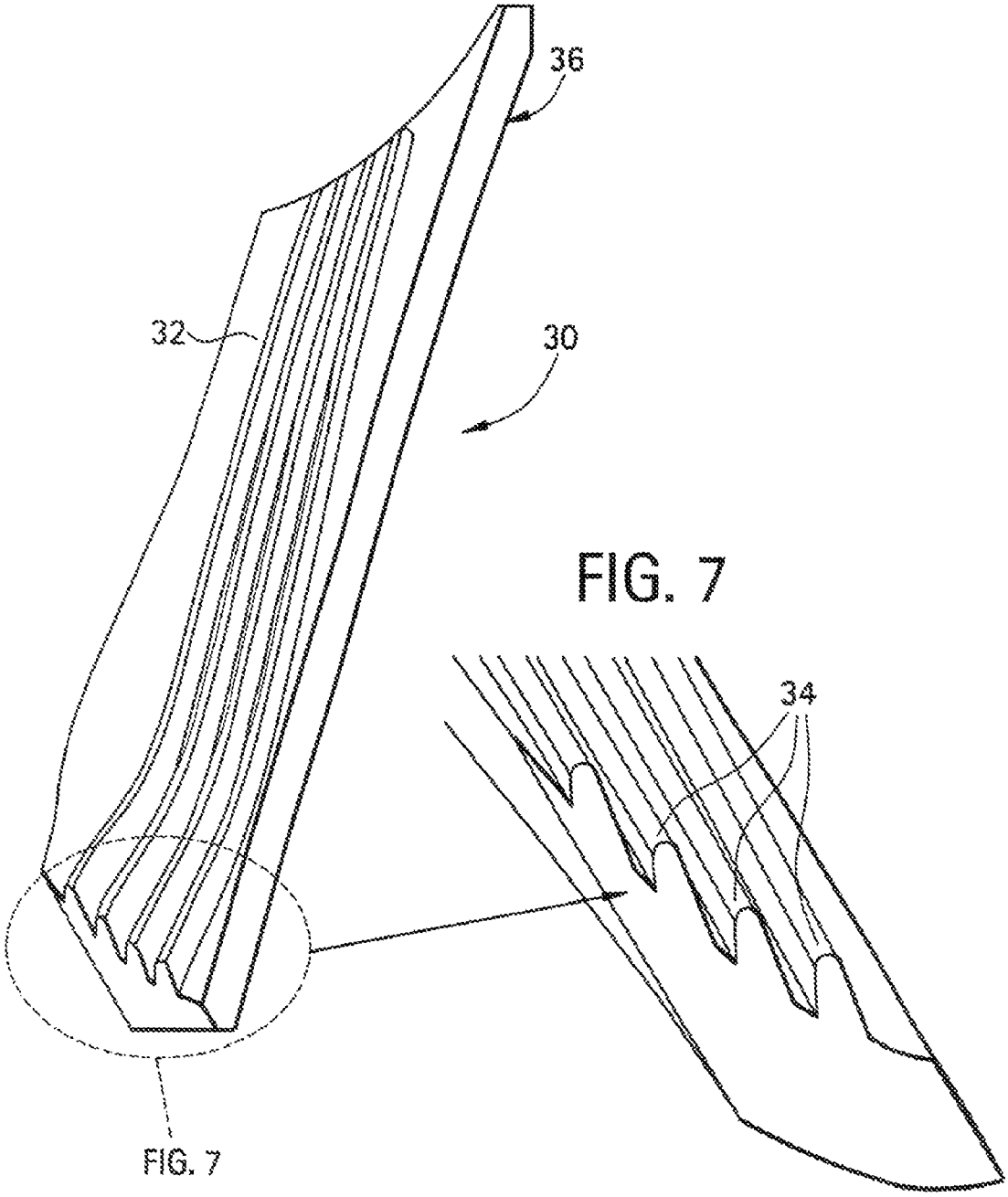
FIG. 6 is an exemplary embodiment of a spacer to be disposed on a turbine blade.
FIG. 7 shows a magnified view of the inner profile of the spacer of FIG. 6.

FIG. 6 illustrates an exemplary embodiment of a spacer 30 for temporarily attachment to the leading edge of the turbine blade 10. The spacer can be machined to have an inner profile corresponding to the surface of the turbine airfoil, leading edge, and/or blade tip. In this embodiment, the spacer 30 has a shape that mirrors the shape of the leading edge 18. The inner profile 32 of the spacer 30 can be disposed on the leading edge 18 of the turbine blade tip. The spacer 30 has a general curvature that can conform to the curved shape of the blade's leading edge. As can be seen in the magnified view of FIG. 7, the inner profile 32 has a plurality of tongues 34 that correspond to the plurality of grooves 22 of the leading edge. The inner profile 32 is configured to matingly engage the surface of the leading edge 18 such that the tongues 34 of the spacer fill in the grooves 22 of the blade when it is attached.

Conversely, the outer profile 36 of the spacer has a substantially uniform curvilinear shape configured to permit uniform heating across the entire surface of the leading edge on which the spacer is disposed. The spacer 30 can further optionally comprise a coating (not shown) on the inner profile 32. As will be discussed in more detail below, the coating can be configured to aid in the removal of the spacer 30 from the turbine blade 10 after hardening.

Figure 8:
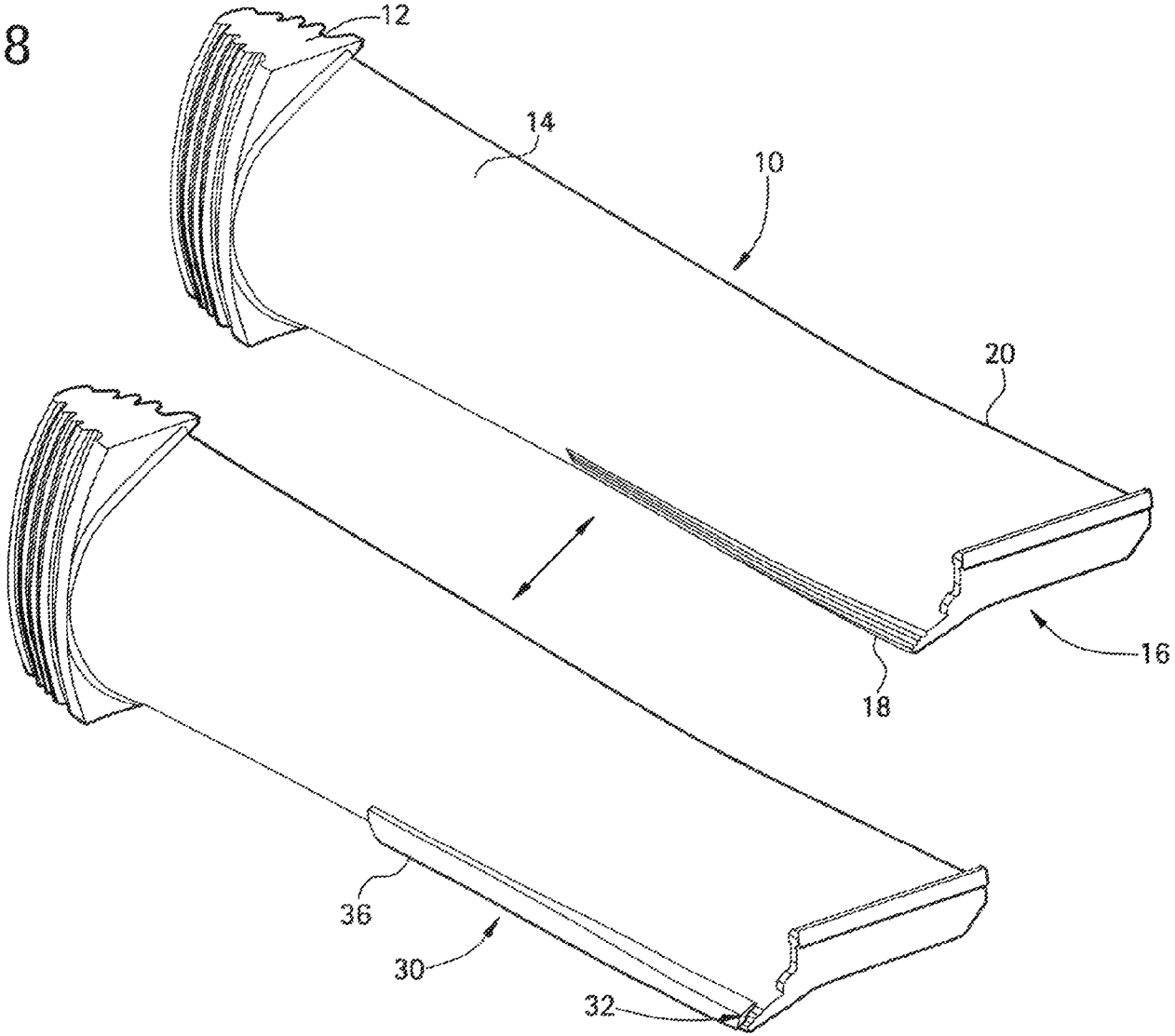
FIG. 8 is an exemplary embodiment of a turbine blade shown (a) without a spacer, and (b) with the spacer attached to the leading edge of the turbine blade.

FIG. 8 illustrates the process of matingly engaging the spacer 30 to the turbine blade 10. As shown in FIG. 8, the outer profile 36 of the spacer 30 corresponds to the general shape of the turbine blade leading edge 18 and airfoil 14, and provides a uniform profile for heating. The inner profile 32 matingly engages the surface of the leading edge 18 and the spacer is held in place during the heating and cooling steps. The blade 10 can be heated and cooled to harden the blade, wherein the spacer 30 is disposed between the heating/cooling sources and the blade tip and edge. The outer profile 36 of the spacer is effective to distribute the heat evenly across the shape of the leading edge, thereby generating a hardened blade tip of uniform microstructure and desirable grain size. It should be noted that the spacer strip can be configured to uniformly heat any surface of the workpiece. The specific shape and position shown in FIG. 8 is not intended to be limiting as will be described in greater detail below. The mating engagement of the two components enables solid conduction heating from the heat source, through the spacer, into the blade edge and/or tip. In a different embodiment, the inner profile of the spacer does not mirror the surface of the blade tip, and therefore, does not fill the contours.

The outer profile 36 of the spacer 30 shown in FIG. 6 has a substantially smooth surface, meaning free of contours. Both the heating and cooling sources can be in direct contact with the outer profile 36. The substantially smooth profile can beneficially permit the heating flux to distribute evenly across the turbine blade cross-section, in this case the blade edge. Likewise, the same smooth outer profile allows the blade edge to cool uniformly as well. Together, the spacer shape ensures the critical areas of the blade edge and tip, such as the grooves and the like, have a uniform microstructure and proper metallurgical characteristics. In another embodiment, the outer profile can be contoured as well. The outer profile can be contoured to have the same shape as the inner profile, or it can be machined to have a shape different than that of the inner profile. The determined shape of the outer profile will depend upon the blade shape, the heating and/or cooling source, and the desired metallurgical properties of the hardened blade. For example, the outer profile of the spacer can be contoured to provide a non-uniform heat flux, like a heat gradient, which might be more advantageous to achieve the uniform microstructure of a complex blade profile.

While the figures illustrate a spacer designed to be temporarily attached to a blade edge, it is to be understood that other portions of the turbine blade can benefit from use of the spacer during heat treatment as previously noted. The shape, size, and attachment location of the spacer will depend upon the profile and design complexity of the turbine blade. For example, in one embodiment the spacer can be temporarily attached to the blade tip of the turbine blade. In another embodiment, the spacer can be temporarily attached to the airfoil portion of the turbine blade. In yet another embodiment, one or more spacers can be temporarily attached to a selected one or all of the blade edges, airfoil portion, and the blade tip portion.

The spacer as disclosed herein can be shaped (for example formed through machining) to the profile of the mating surface of the workpiece to which it is fixed. The dimensions of the spacer will be directly related to the dimensions of the workpiece. Additional factors for the spacer dimensions can include, without limitation, the thickness of the workpiece, the material of the spacer, the material of the workpiece, the heating method, the cooling method, and the like. The spacer can be attached to the workpiece by any method that does not permit movement or permanent adhesion during the heating process and the cooling process. Temporary attachment of the spacer is intended to generally mean the spacer is prevented from permanently adhering to the turbine blade; the spacer is prevented from moving during both the heating and cooling steps; and the spacer can be removed from the turbine blade upon completion of the hardening process, typically after the cooling step. In an exemplary embodiment, the inner profile (i.e., the mating face) of the spacer can be coated with a coating, which can prevent the spacer from bonding to the turbine blade during the heating process. The coating can comprise a thin oxide based paint that can be coated on the inner profile of the spacer. In another embodiment, the coating can be a film of an oxide based paint disposed between the spacer and the turbine blade as the spacer is attached. Exemplary oxide based paints can include, without limitation, aluminum oxide, magnesium oxide, titanium oxide, calcium oxide, and other like oxide based paints. The coating can have a thickness suitable to prevent the spacer from sticking to the turbine blade, while being thin enough to permit convectional heating between the spacer and the turbine blade. An exemplary coating thickness can be less than or equal to about 5 mils. After the turbine blade cools, the un-bonded spacer is removed by physically pulling the spacer away from the turbine blade. To aid in this removal, an optional tab can be on the spacer and/or the thin oxide film. The tab provides a part that can be easily grabbed by hand or by mechanical methods (e.g., pliers), to provide leverage when removing the spacer from the blade. Moreover, depending on applications and material properties, the spacer can be configured for reuse for the hardening of multiple parts, or it can be disposable.

The spacer can comprise any metal capable of withstanding the desired heating method, i.e., without melting during the heating of the workpiece. Exemplary spacer metals include materials with melting points equal to or greater than about 2000 degrees Fahrenheit (° F.). The spacer material is selected so that the spacer can be reused for multiple iterations of the hardening heat treatment process on similar shaped and composed workpieces. The hardening process, therefore, can be more economical than some current processes. Suitable alloys are typically copper-based, nickel-based, iron-based, or cobalt-based alloy, wherein the amount of copper, nickel, iron, or cobalt in the superalloy is the single greatest element by weight. Illustrative nickel-based superalloys include at least nickel (Ni), and at least one component from the group consisting of cobalt (Co), chromium (Cr), aluminum (Al), tungsten (W), molybdenum (Mo), titanium (Ti), tantalum (Ta), zirconium (Zr), niobium (Nb), rhenium (Re), carbon (C), boron (B), hafnium (Hf), and iron (Fe). Examples of nickel-based superalloys are designated by the trade names Haynes® and Hasteloy® produced by Haynes International, Inc., Incoloy®, Inconel®, Nimonic®, and Udimet® produced by Special Metals Corp., Rene® (e.g., Rene®80, Rene®95, Rene®142, and Rene®N5 alloys) produced by Reade, and include directionally solidified and single crystal superalloys. Illustrative cobalt-base superalloys include Co, and at least one component from the group consisting of Ni, Cr, Al, W, Mo, Ti, and Fe. Examples of cobalt-based superalloys are designated by the trade names Haynes®, Nozzaloy® produced by General Electric, Stellite® produced by Deloro Stellite Co., and Ultimet® materials. Illustrative iron-base superalloys include Fe, and at least one component from the group consisting of Ni, Co, Cr, Al, W, Mo, Ti, and manganese (Mn). Examples of iron based superalloys are designated by the trade names Haynes®, Incoloy®, Nitronic® produced by G.O. Carlson, Inc. Suitable steels include stainless steels such as American Iron and Steel Institute (AISI) steels: AISI 304 stainless steel, 310 stainless steel, AISI 347 stainless steel, AISI 405 stainless steel, AISI 410 stainless steel, Alloy 450 stainless steel, and the like.

As previously stated, the workpiece can be any component where hardening through heat treatment is desirable. While reference is made herein to workpieces formed of martensitic steels, the process described can be applicable for use with any materials that can be hardened to improve the desired properties (e.g., hardness for wear resistance, bending and torsional strength, fatigue life, and the like). Again, the desirable high temperature properties of the workpiece are owed to the uniform microstructure generated by the hardening heat treatment process described herein.

Once the spacer has been temporarily attached to the workpiece, the hardening heat treatment further includes heating and cooling of the workpiece. Using steel as an example, the steel is heated via the conduction of heat through the spacer, to cause the grain structure of the steel to become austenitic (austenitized). The temperature and duration of the heating can be varied to control the depth of austenitization in the workpiece as well as the grain size of the austenite. For turbine blade applications, the grain size for the leading edge and blade tips can be about ASTM 5 or finer, as measured by ASTM standard E112. After the steel has become austenitic, the workpiece can be quickly quenched (i.e., cooled), transforming the austenite to martensite. Again, the cooling of the workpiece is done conductively through the spacer, as the spacer is the surface in direct contact with the cooling source. In contrast to quick quenching, slow cooling causes transformation, as the temperature passes through the corresponding ranges, to pearlite, bainite, and martensite, with the final structure being a combination of the three. The result is relatively soft and ductile steel. To achieve the hardness required for turbine applications, therefore, the steel must be cooled rapidly so that it bypasses the first two transformation phases and transforms directly from austenite to martensite. Such hardening results in high wear resistance.

The heating source can be any method capable of altering the microstructure of the workpiece material as described above. In one embodiment, the heating source can be a flame, such as from a torch for example. Flame hardening typically employs direct impingement of a high-temperature flame or high-velocity combustion product gases. The high temperature flame is obtained by combustion of a mixture of fuel gas with oxygen or air; flame heads are used for burning the mixture. Depths of hardening depend on the fuels used, the design of the flame head, the duration of heating, the hardenability of the work material, and the quenching medium and method of quenching used.

In another embodiment, induction heating can be used. Induction hardening generally includes heating a metal part by electromagnetic induction, where eddy currents are generated within the metal and resistance leads to Joule heating of the metal. An induction heater generally includes an electromagnet, through which a high-frequency alternating current (AC) is passed. Heat may also be generated by magnetic hysteresis losses. The depth of induction hardened patterns can be controlled through choice of induction-frequency, power-density and interaction time. Regardless of the heating source chosen, the disclosed process advantageously permits the use of the heating to be automated, as the need for manual heating of the various blade geometries is eliminated by the use of the spacer. Moreover, regardless of the heating method, the heat source directly heats the spacer, but the heat source does not directly come into contact with the workpiece.

For the process disclosed herein, the turbine blade can be heated such that the martensitic steel is hardened through. In other words, in turbine blade applications it is typically preferred to have a completely hardened blade rather than a martensitic shell. The depth of hardening, therefore, can be about 1 millimeter (mm) to about 25 mm depending on the part of the blade being hardened. For example, a blade tip can be completely hardened through at a depth of about 1 mm or less, while the base airfoil structure can be hardened to a depth of about 25 mm or greater.

The cooling source can be any source capable of reducing the temperature of the workpiece at a rate to transform the austenitic structure to martensitic structure. Exemplary cooling sources can include, without limitation, immersion quenching, spray quenching, air cooling, and the like. The fluid for the quenching methods can include, without limitation, water, salt solution, soluble oil, simulated oil in the form of a polymer-based quenchant, air, and the like. Whatever the cooling source, it should reach the heated workpiece when the material is still at the critical temperature to avoid the formation of pearlite and other undesirable transformation products in the microstructure as described above.

As stated previously, the hardening heat treatment process described herein produces a hardened turbine blade with uniform microstructure. This uniform microstructure improves the erosion and stress corrosion performance of the final turbine blade product. Moreover, because of the spacer design, the process achieves a uniform microstructure for workpieces with complex geometries, without requiring the addition of a permanent shield or coating to effect the desired properties. Even further, the spacer can be reused for multiple iterations of the hardening heat treatment process on similar shaped and composed workpieces.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment" and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While the invention has been described with reference to a preferred embodiment, it will be understood that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A heat treatment process for hardening a workpiece surface, comprising:

attaching a spacer to a workpiece surface, wherein the spacer comprises an inner profile mirroring the workpiece surface and an outer profile effective to generally uniformly distribute heat to the workpiece surface;

disposing a thin oxide based paint between the inner profile of the spacer and the workpiece surface, wherein the thin oxide based paint comprises aluminum oxide, titanium oxide, calcium oxide, magnesium oxide, or a combination comprising at least one of the foregoing;

heating the spacer to uniformly heat the workpiece surface at a temperature effective to form an austenitic microstructure in the workpiece surface;

cooling the workpiece surface at a rate effective to transform the austenitic microstructure to a martensitic microstructure; and removing the spacer from the workpiece prior to or subsequent to cooling.

2. The heat treatment process of claim 1, wherein the workpiece is a turbine blade.

3. The heat treatment process of claim 2, wherein the turbine blade is a steam turbine blade.

4. The heat treatment process of claim 1, wherein the spacer comprises a copper-based alloy, a nickel-based alloy, an iron-based alloy, a cobalt-based alloy, or a combination comprising at least one of the foregoing.

5. The heat treatment process of claim 1, wherein the outer profile of the spacer is substantially flat.

6. The heat treatment process of claim 1, wherein the outer profile of the spacer has a contoured shape.

7. The heat treatment process of claim 1, wherein the heating source is a flame.

8. The heat treatment process of claim 1, wherein the heating source is an induction heating system.

9. The heat treatment process of claim 1, wherein the heating source is automated.

10. The heat treatment process of claim 1, wherein the heating source is manual.

11. The heat treatment process of claim 1, wherein the workpiece surface comprises a steel containing carbon.

12. The heat treatment process of claim 1, wherein the cooling the workpiece surface comprises air cooling the workpiece surface, spray quenching the workpiece surface with a fluid, immersion quenching the workpiece surface with a fluid, or a combination comprising at least one of the foregoing, wherein the fluid comprises water, a soluble oil, a polymer-based quenchant, a salt solution, or a combination comprising at least one of the foregoing.

13. A heat treatment process for hardening a metal workpiece, comprising:

matingly engaging a spacer to a shaped workpiece, wherein the spacer has an inner profile that mirrors the shape of the workpiece and an outer profile effective to permit a generally uniform heating flux to form across a surface of the shaped workpiece;

disposing a thin oxide based paint between the inner profile of the spacer and the workpiece surface, wherein the thin oxide based paint comprises aluminum oxide, titanium oxide, calcium oxide, magnesium oxide, or a combination comprising at least one of the foregoing;

heating the spacer and the shaped workpiece to cause a first generally uniform heat flux on the surface of the shaped workpiece;

cooling the spacer and the shaped workpiece to cause a second generally uniform heat flux on the surface of the shaped workpiece, wherein the cooling is at a rate effective to increase a hardness property to the surface of the workpiece; and removing the spacer from the shaped workpiece.

14. The heat treatment process of claim 13, wherein the shaped workpiece is a turbine blade.

15. The heat treatment process of claim 14, wherein the turbine blade is a steam turbine blade.

16. The heat treatment process of claim 13, wherein the outer profile is substantially flat.

17. The heat treatment process of claim 13, wherein the outer profile has a contoured shape.

18. The heat treatment process of claim 13, wherein the cooling the spacer and the shaped workpiece comprises air cooling the spacer, spray quenching the spacer with a fluid, immersion quenching the spacer with a fluid, or a combination comprising at least one of the foregoing, wherein the fluid comprises water, a soluble oil, a polymer-based quenchant, a salt solution, or a combination comprising at least one of the foregoing.

* * * * *